US006827524B2

(12) United States Patent
Starry, Jr. et al.

(10) Patent No.: US 6,827,524 B2
(45) Date of Patent: Dec. 7, 2004

(54) CONTROLLER FOR A COMPACTING VEHICLE WETTING SYSTEM

(75) Inventors: Dale W. Starry, Jr., Shippensburg, PA (US); Kenneth E. Gasper, Chambersburg, PA (US); Steve Kunkel Yates, Scotland, PA (US); Chad L. Fluent, St. Thomas, PA (US)

(73) Assignee: Ingersoll-Rand Company, Montvale, NJ (US)

( * ) Notice: Subject to any disclaimer, the term of this patent is extended or adjusted under 35 U.S.C. 154(b) by 0 days.

(21) Appl. No.: 10/205,872

(22) Filed: Jul. 26, 2002

(65) Prior Publication Data

US 2004/0018053 A1 Jan. 29, 2004

(51) Int. Cl.[7] ..... E01D 19/26
(52) U.S. Cl. ..... 404/129; 404/122
(58) Field of Search ..... 404/129, 122, 404/124; 239/1, 71

(56) References Cited

U.S. PATENT DOCUMENTS

| | | | | |
|---|---|---|---|---|
| 2,430,781 A | | 11/1947 | Phalor | |
| 3,675,546 A | | 7/1972 | Smith | |
| 3,782,634 A | | 1/1974 | Herman | |
| 4,009,967 A | | 3/1977 | Layton | |
| 4,040,762 A | | 8/1977 | Nilsson | |
| 4,052,003 A | * | 10/1977 | Steffen | 239/71 |
| 4,421,435 A | | 12/1983 | Zemke et al. | |
| 4,637,547 A | * | 1/1987 | Hiniker et al. | 239/1 |
| 4,803,626 A | * | 2/1989 | Bachman et al. | 701/50 |
| 5,222,828 A | | 6/1993 | Magalski | |
| 5,781,874 A | | 7/1998 | Troppman et al. | |
| 5,890,834 A | | 4/1999 | Waldenberger | |
| 5,957,622 A | | 9/1999 | Vera-Montiel | |

FOREIGN PATENT DOCUMENTS

| | | |
|---|---|---|
| DE | 1 175 260 B | 8/1964 |
| EP | 0 109 303 A2 | 5/1984 |
| EP | 0 864 369 A2 | 9/1998 |

* cited by examiner

*Primary Examiner*—Robert E. Pezzuto
*Assistant Examiner*—Raymond W Addie
(74) *Attorney, Agent, or Firm*—Michael Best & Friedrich LLP

(57) ABSTRACT

A controller is for a vehicle wetting system including a fluid supply and a delivery line having an inlet connected with the supply and an outlet located to direct fluid onto a compacting drum. The controller includes a regulator configured to adjust a fluid flow rate through the outlet. A speed sensor connected with the vehicle senses vehicle speed. Further, a logic circuit connected with the sensor and the regulator automatically operates the regulator such that the regulator adjusts the flow rate to be generally proportional to the vehicle speed. Alternatively, the logic circuit permits flow through the outlet for a predetermined drum displacement and alternately interrupts flow for a predetermined period of time. The regulator is either a shunt line and a valve adjusting flow through the shunt line to adjust flow through the outlet or a pump regulator controlling flow from a pump in the delivery line.

21 Claims, 10 Drawing Sheets

CONTROLLER FOR A COMPACTING VEHICLE WETTING SYSTEM

BACKGROUND OF THE INVENTION

The present invention relates to compacting vehicles, and more particularly to systems for watering or wetting the drums of a compacting vehicle.

Compacting vehicles or compactors are known and basically include a frame and one or two drums connected with the frame, the single drum vehicles including a pair of wheels in place of a second drum. Double drum compactors are typically used to compact mats of paving material (e.g., asphalt) formed by a paver to construct roadways, airport runways, parking lots or the like. Basically, the compacting vehicle continuously rolls back and forth over portions of the material mat such that the weight of the vehicle, aided by impacts from vibratory mechanisms within the drums, is transferred through the drums to compact the mat to a desired density.

During such compaction operations, it is desirable to continuously apply or coat the outer surfaces of the drums with a "wetting" fluid, typically water or a water-based solution. Otherwise, paving material tends to adhere to the outer surface of the drum(s), creating rips or tears in the mat where adhered material is pulled from the mat, depressions in the mat where the adhered material is pressed against the mat upper surface and/or high spots on the mat when the material is subsequently forced back onto the mat from the drum surface. In general, the hotter the material or the more "severe" the ambient conditions, the greater the volume of water/fluid required to adequately coat the drum outer surface to prevent dry spots from forming by evaporation. Further, the faster the rolling speed of the compactor, the greater the volume of water necessary to ensure that the drum surface remains coated to avoid material adhesion.

Generally, compacting vehicles are provided with a watering or "wetting" system that typically includes a supply of fluid, such as a fluid/water tank, fluid lines or hoses connected with the tank and a pump to drive the fluid from the tank and through the hoses. Further, one or more nozzle devices, such as multi-ported sprayer bars, are typically located near the drum to distribute fluid across the drum outer surface. As the supply of water is carried on board the vehicle, the water capacity of the wetting system, both in terms of the total volume of fluid available in the tanks and the total time to completely empty the tanks, is an important limitation of a compacting vehicle. As the water or other fluid must be replenished when the fluid supply is emptied, the compaction operation must therefore be halted for the amount of time necessary to replenish the water/fluid supply.

Various methods have been employed in the past to conserve water usage. One known method of conserving water usage is to provide a control system to automatically start and stop the wetting system when the compacting vehicle is respectively started from rest or stopped during a compaction operation. Further, manual controls, such as a manually-operated rheostat, have been provided to enable a vehicle operator to adjust the flow rate from the pumps to adapt to varying conditions of the material mat and operational speeds. However, particularly with less experienced operators, the operators often tend to just set the pump flow rate to the maximum rate, thereby failing to conserve wetting fluid and defeating the purpose of providing such controls. In addition, excessive wetting fluid applied to the drums tends to run-off onto the material mat and cause premature cooling of certain mat sections. Subsequent compaction by the drums, especially when performed in combination with a higher level of drum vibratory mechanisms, may cause superficial or shallow surface cracks to form in the material mat, which may reduce the intended useful life of the mat.

Therefore, in view of the above-discussed limitations with known wetting systems, it would be desirable to provide a control system for a compactor watering or wetting system that more adequately conserves water or other wetting fluid and which prevents the occurrence of excessive wetting that may lead to fluid-runoff.

SUMMARY OF THE INVENTION

In one aspect, the present invention is a control system for a system for applying fluid onto a drum of a compacting vehicle. The fluid applying system or "wetting" system includes a fluid supply and a fluid delivery line having an inlet fluidly connected with the fluid supply and an outlet located so as to direct fluid onto the drum. The control system basically comprises a regulator configured to adjust a rate of fluid flow through the outlet. A speed sensor is connected with the vehicle and is configured to sense vehicle travel speed. Further, a logic circuit is operatively connected with the speed sensor and with the regulator. The logic circuit is configured to automatically operate the regulator when vehicle speed changes such that the regulator adjusts the flow rate through the outlet to be generally proportional to the sensed vehicle speed.

In another aspect, the present invention is also a control system for the wetting system described above. The control system basically comprises a regulator configured to adjust fluid flow through the outlet and a sensor configured to sense rotation of the drum. A logic circuit is operatively connected with the sensor and with the regulator. The logic circuit is configured to operate the regulator such that fluid flow through the outlet is permitted for either one of a predetermined travel distance or displacement of the drum and a predetermined period of time. Further, the fluid flow through the outlet is alternately interrupted for either one a predetermined period of time and a predetermined travel distance of the drum.

In a further aspect, the present invention is also a control system for the wetting system described above. The control system basically comprises a regulator configured to adjust fluid flow through the outlet and a sensor configured to sense rotation of the drum. A logic circuit is operatively connected with the sensor and with the regulator and is configured to selectively operate the regulator in a first operational mode and alternatively in a second operational mode. In the first operational mode, the regulator maintains a rate of flow through the delivery line outlet to be generally proportional to vehicle speed. In the second operational mode, fluid flow through the outlet is permitted for a predetermined travel distance or displacement of the drum and alternately interrupted for a predetermined period of time.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DETAILED DESCRIPTION OF THE INVENTION

Figure 1:
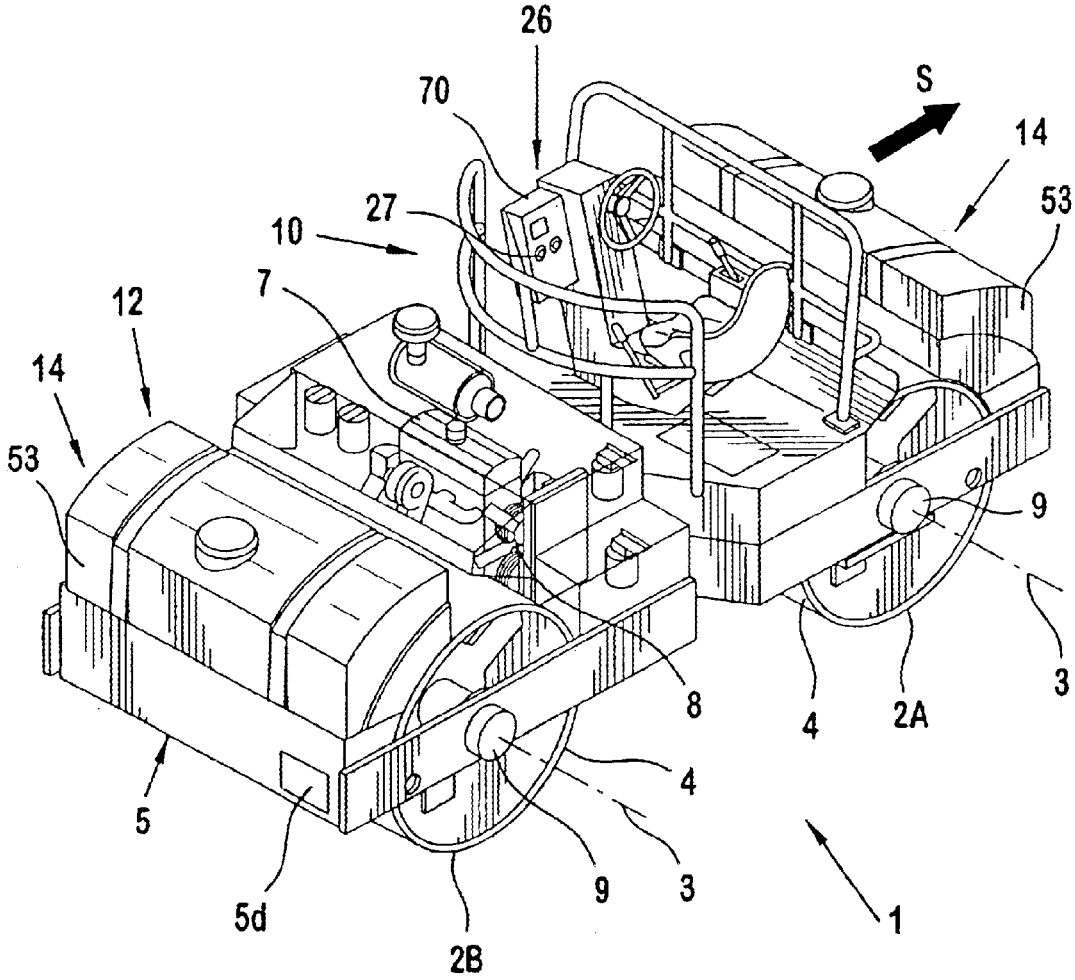
FIG. 1 is a rear perspective view of a compacting vehicle having a fluid wetting system and a control system therefor in accordance with the present invention.

Referring now to the drawings in detail, wherein like numbers are used to indicate like elements throughout, there is shown in FIGS. 1–11 a presently preferred embodiment of a control system 10 for a system 12 for applying a fluid onto at least one drum 2 of a compacting vehicle 1. The fluid-applying or "wetting" system 12 includes a fluid supply 14 and at least one fluid delivery line 16 having an inlet 18 fluidly connected with the fluid supply 14 and an outlet 20 located so as to direct fluid onto the drum 2. The control system 10 basically comprises a regulator 22, a speed sensor 24 and a logic circuit 26 operatively connected with the regulator 22 and the speed sensor 24. The regulator 22 is configured to adjust a rate of fluid flow "$R_A$" through the delivery line outlet 20, thereby adjusting the quantity or amount of fluid "$F_A$" applied to the drum 2. The speed sensor 24 is connected with the vehicle 1 and configured to sense vehicle travel speed "S". Preferably, the speed sensor 24 is further configured to sense rotational displacement $d_R$ of the drum 2 about a drum central axis 3 (i.e., axis of rotation). Alternatively, the control system 10 may include a separate displacement sensor 25 (shown in phantom—FIG. 2) configured to sense rotational displacement $d_R$ of the drum 2 about the axis 3, as discussed below.

Figure 8:
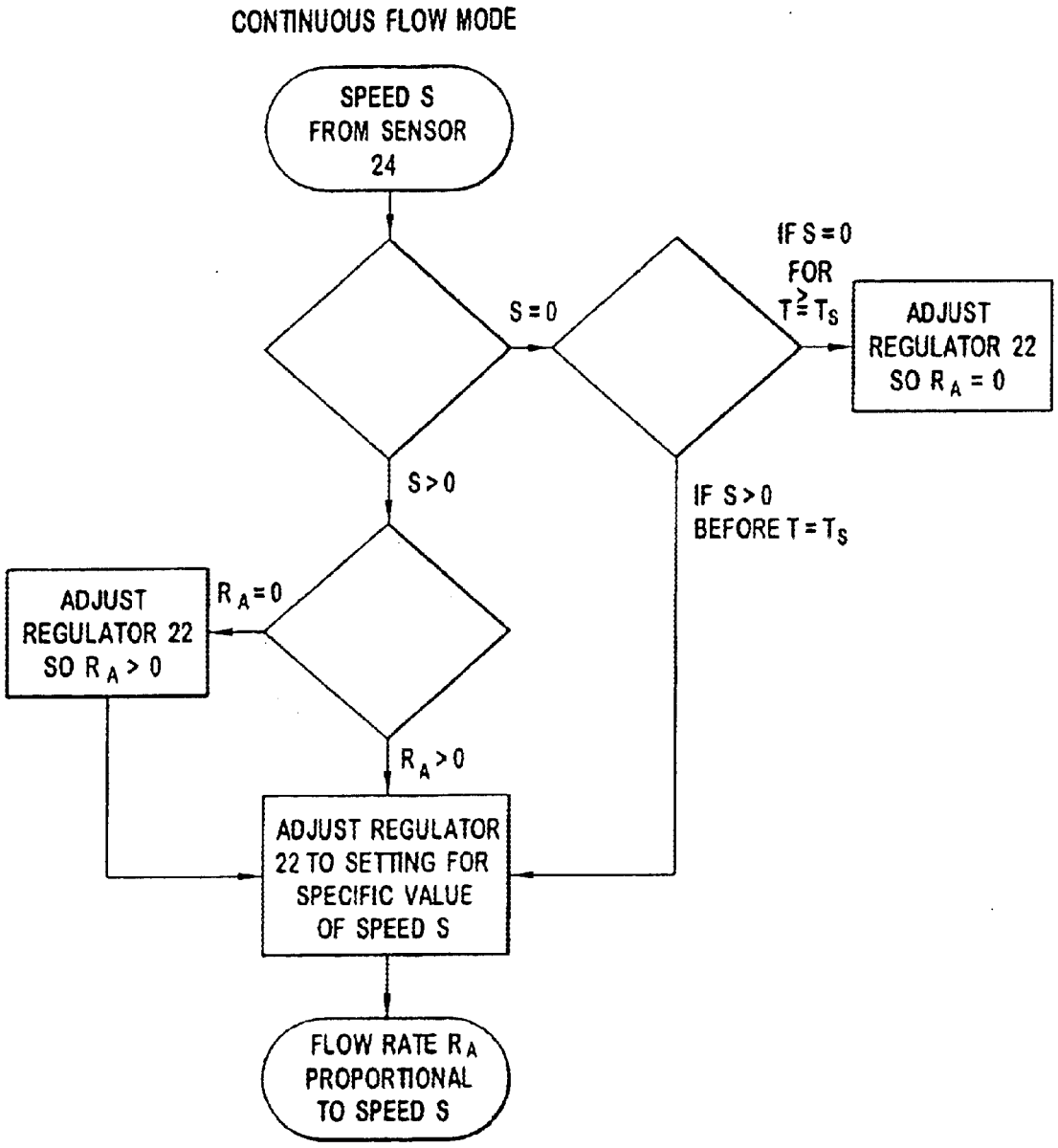
FIG. 8 is a process flow diagram illustrating a first, continuous flow operational mode of the control system, showing an open-loop regulator control arrangement.

Further, the logic circuit 26 is operatively connected with the speed sensor 24 and with the regulator 22 and is preferably configured to automatically operate the regulator 22 to maintain the flow rate $R_A$ though the delivery line outlet 20 to be generally proportional to vehicle speed S. In other words, when the travel speed S of the vehicle 1 changes, the regulator 22 adjusts the flow rate $R_A$ through the outlet 20 such that the rate $R_A$ remains generally proportional to the sensed vehicle speed S. More specifically, the logic circuit 26 is configured (i.e., constructed or programmed) to operate the regulator 22 such that the regulator 22 increases the fluid flow rate $R_A$ through the outlet 20 when the sensed vehicle speed S increases and to alternately decrease the fluid flow rate $R_A$ through the outlet 20 when the sensed vehicle speed S decreases. The above-described manner by which the logic circuit 26 operates the regulator 22 is hereinafter referred to as a "continuous flow mode", and is preferably one of a plurality of different operational modes, as depicted in FIG. 8 and described below.

Figure 2:
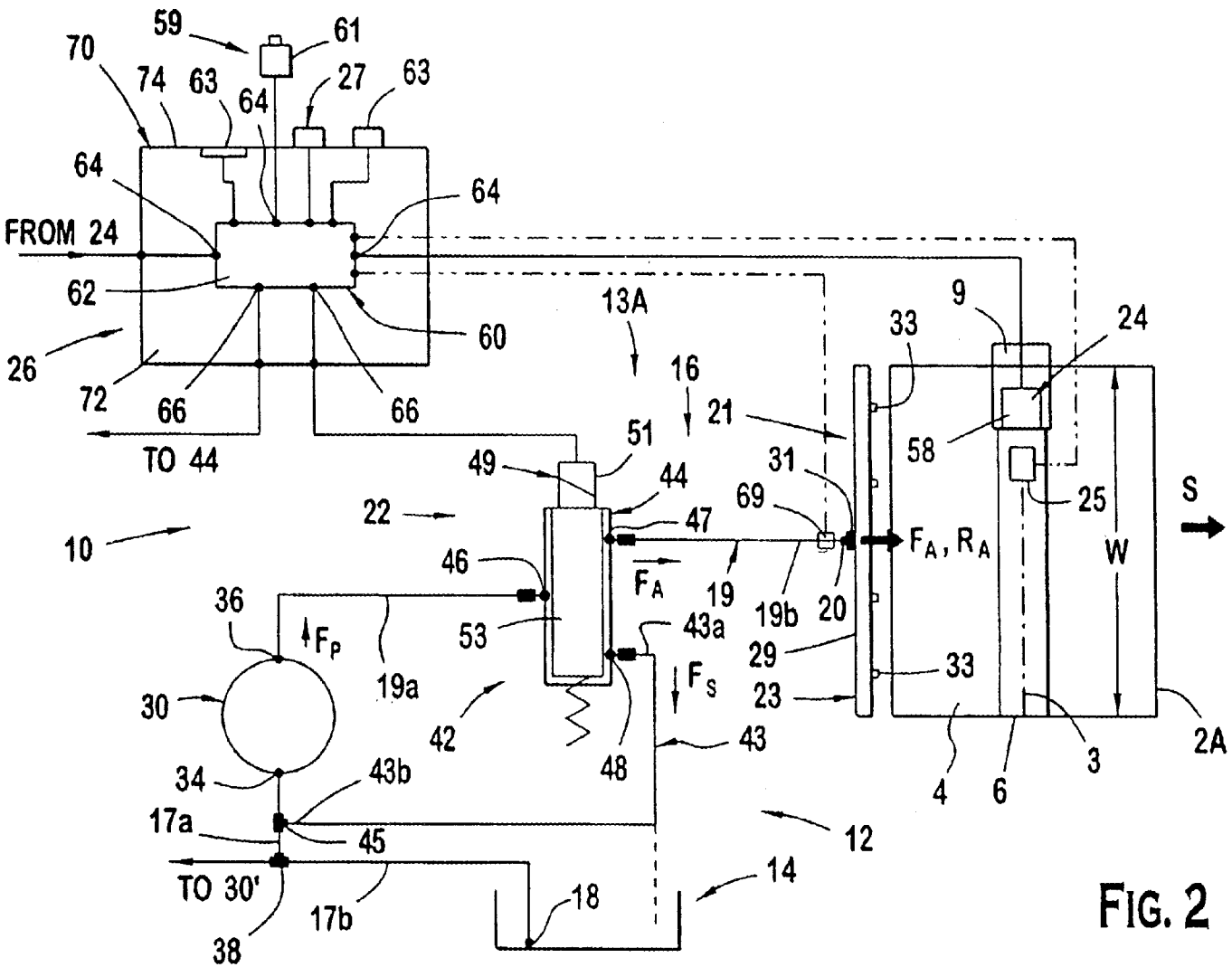
FIG. 2 is a schematic view of the control system of the present invention, shown with a first preferred construction of a regulator.
Figure 3:
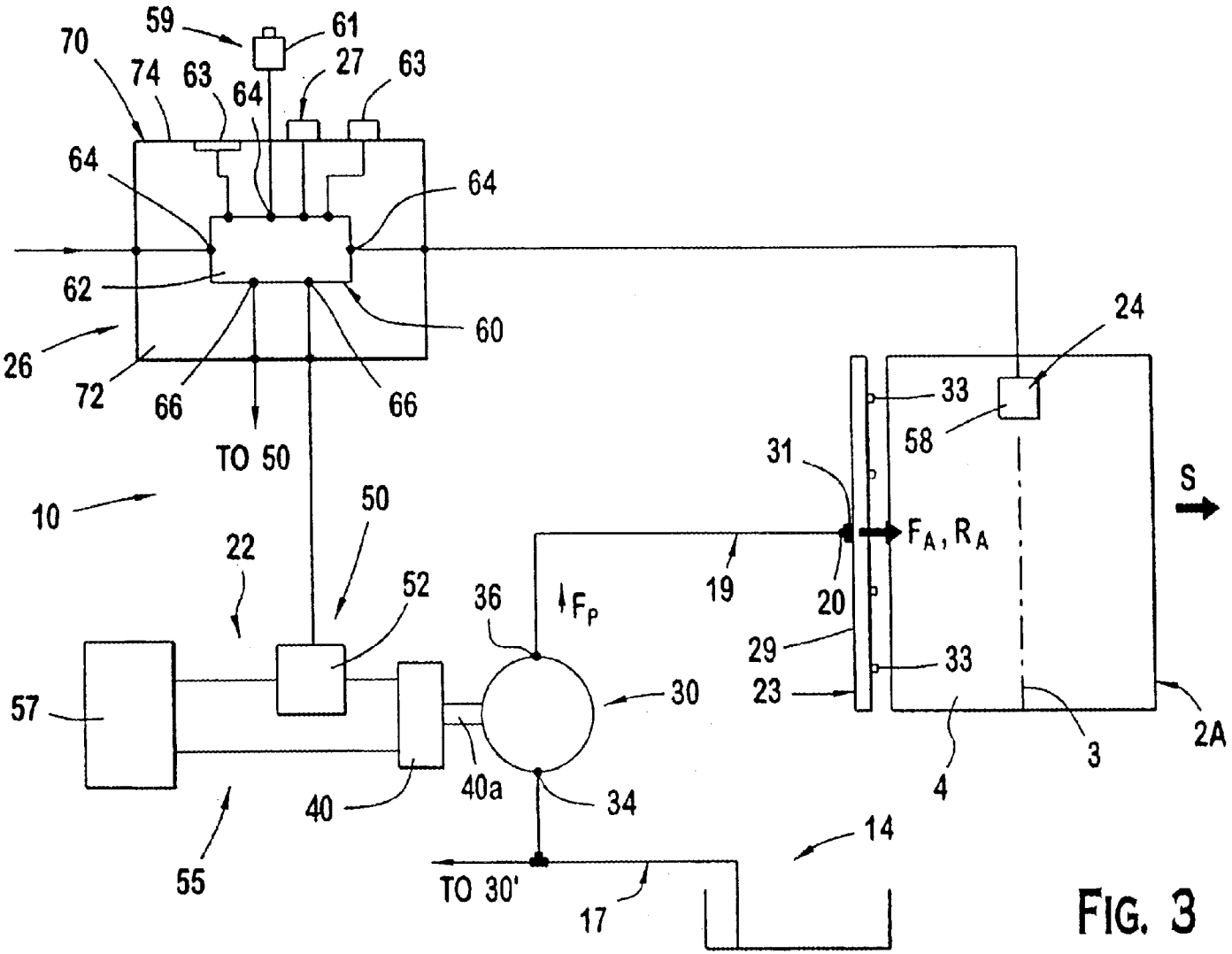
FIG. 3 is a schematic view of the control system shown with a second preferred construction of the regulator.
Figure 9:
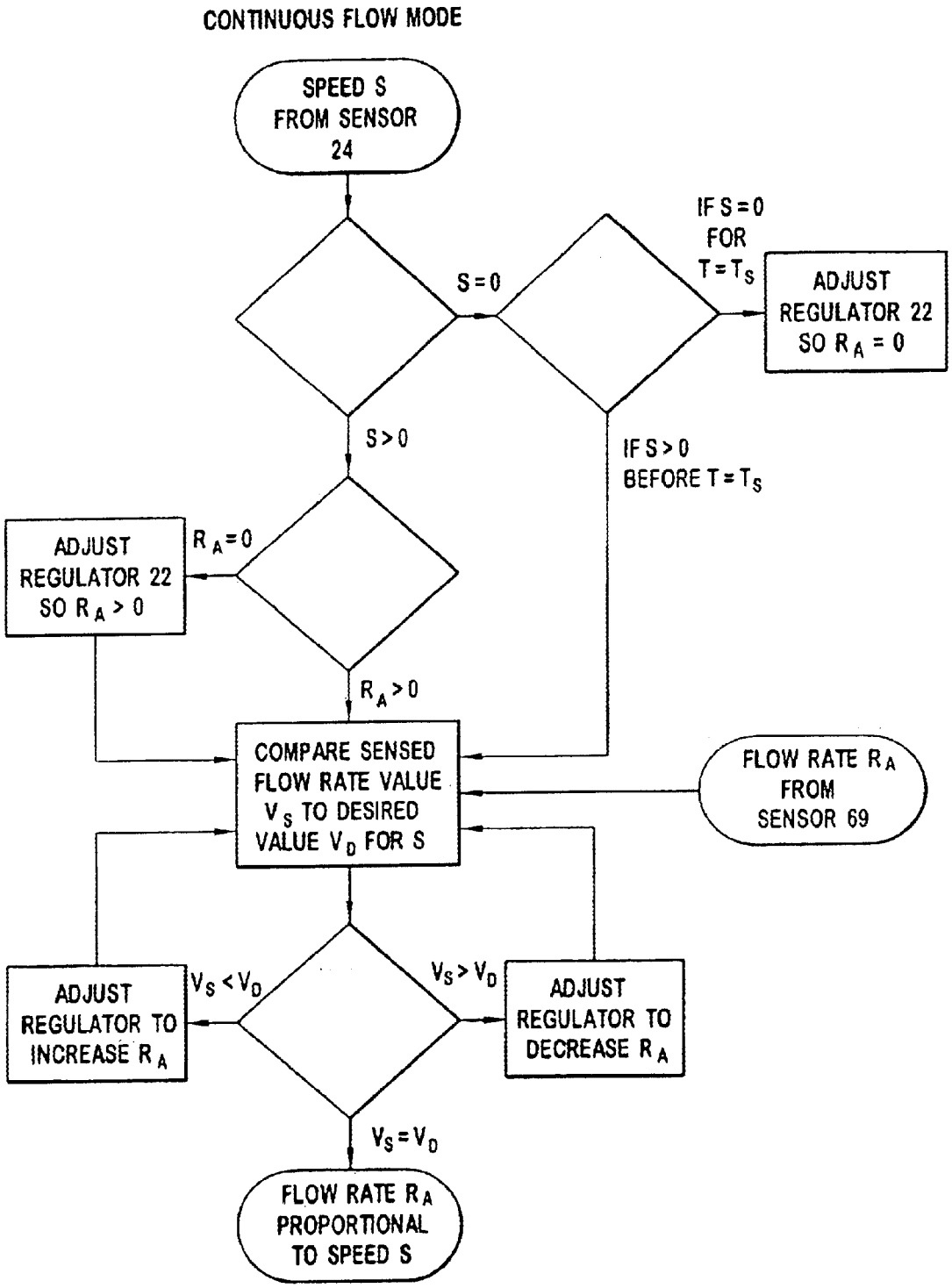
FIG. 9 is a process flow diagram illustrating a first, continuous flow operational mode of the control system, showing an closed-loop regulator control arrangement.

Referring particularly to FIGS. 2, 3 and 9, the logic circuit 26 is preferably further configured to alternatively operate the regulator 22 in a two part/cycle "intermittent flow mode" that proceeds generally as follows. In the intermittent flow mode, the regulator 22 permits or activates fluid flow through the outlet 20, preferably for a predetermined rotational displacement $d_R$ of the drum 2 (a "wetting cycle"), and alternately interrupts flow through the outlet 20, preferably for a predetermined period of time (an "interrupt cycle"). Preferably, the described wetting cycle occurs for one complete revolution of the drum 2, but the wetting cycle may have a duration of only a partial drum revolution, of multiple drum revolutions, or even a predetermined period of time.

Figure 10:
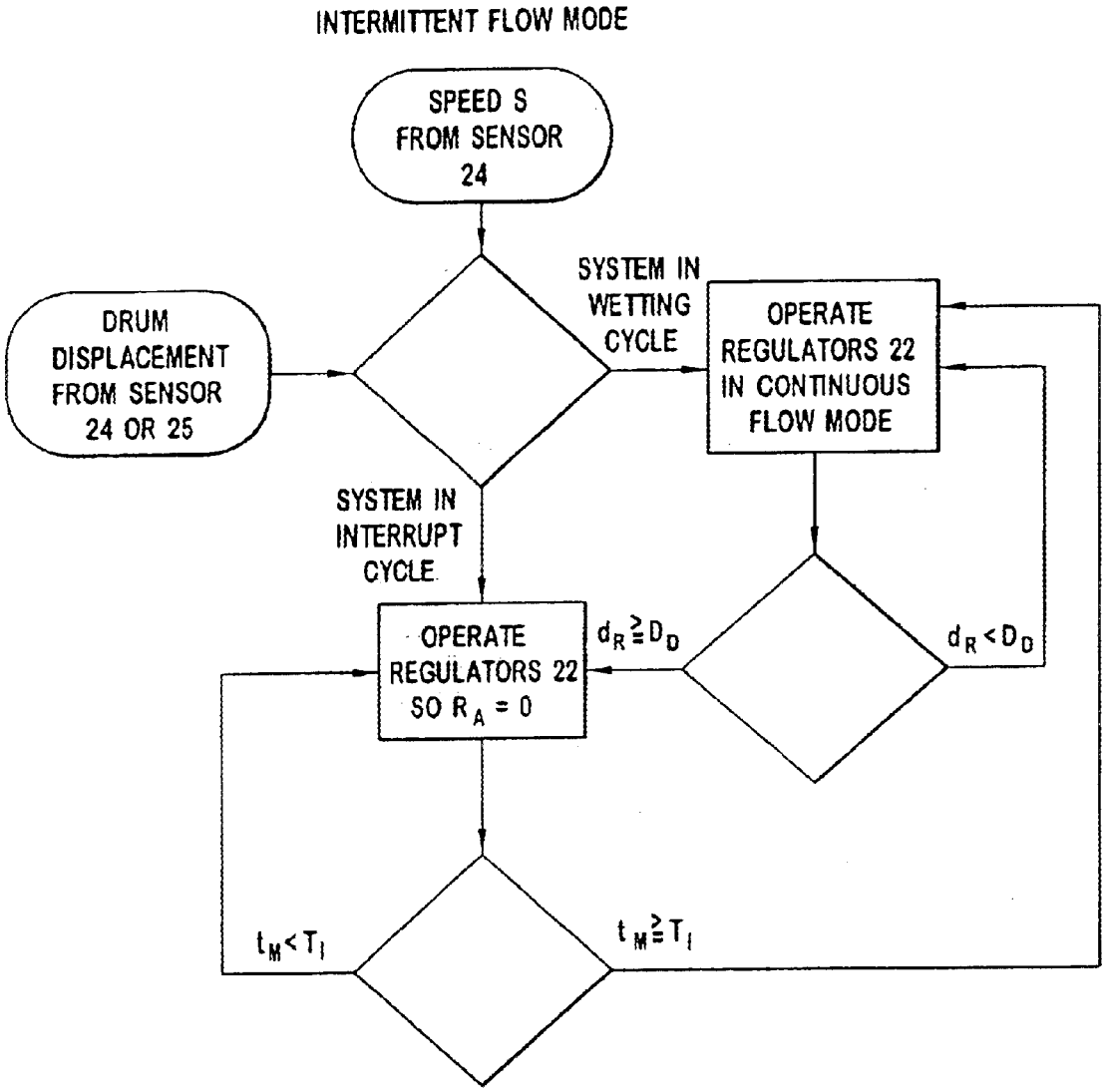
FIG. 10 is a process flow diagram illustrating a second, intermittent flow operational mode of the control system.

Furthermore, the logic circuit 26 is preferably configured to operate the regulator 22 in a first, continuous flow mode (FIGS. 8 and 9) and to alternatively operate the regulator 22 in at least a second, intermittent flow mode (FIG. 10). As such, the control system 10 preferably includes an operator selector device 27 operatively connected with the logic circuit 26. The selector device 27 is configured to enable a vehicle operator to selectively direct the logic circuit 26 to operate the regulator 22 in the first, continuous flow mode and alternately in the second, intermittent flow mode. Further, the selector device 27 is preferably further configured to enable the vehicle operator to selectively direct the logic circuit 26 to operate alternatively in a manual mode, in which the operator is able to manually adjust or set the outlet flow rate $R_A$ to a desired, constant value. However, the logic circuit 26 may be configured to operate the regulator 22 in only one of the two modes described above (i.e., continuous flow mode or intermittent flow mode), such that the control system 10 does not require any type of operator selector device.

Preferably, the wetting system 12 includes a plurality of the fluid delivery lines 16, and most preferably two lines 16 each having a separate outlet 20 and being connected with a separate fluid supply 14. Also, the control system 10 preferably includes a plurality of the regulators 22, most preferably two regulators 22 each operatively connected with a separate one of the two fluid lines 16 so as to adjust the flow rate(s) through the connected fluid line 16. With this structure of the wetting system 12, the logic circuit 26 is preferably configured to operate each of the regulators 22 separately and independently of the other regulator(s) 22, so as to independently control the rate of flow $R_A$ out of each separate delivery line outlet 20. Each of the above basic elements of the control system 10 of the present invention is described in further detail below.

Referring particularly to FIG. 1, the control system 10 of the present invention is preferably used with a wetting system 12 on a conventional compacting vehicle 1 having two compacting drums 2A and 2B (i.e., a "double-drum" compactor) used to compact a mat of paving material (e.g., asphalt), as discussed above. With such a vehicle 1, paving material tends to adhere to the outer surface 4 of the drums 2A, 2B unless the drums 2A, 2B are constantly coated or wetted with an appropriate fluid, as discussed above and in further detail below. The compacting vehicle 1 includes a vehicle chassis or frame 5 and two shaft assemblies 6 each connecting one drum 2A or 2B with the frame 5. A diesel engine 7 is disposed within the frame 5 and drives a primary hydraulic pump 8 (e.g., FIG. 2) located within the frame 5, which provides hydraulic pressure to operate various systems or components of the vehicle 1.

Further, the vehicle 1 includes two hydraulic motors 9 each connected with a separate shaft assembly 6 (only one shown—FIG. 2). The motors 9 are both driven by the primary hydraulic pump 8 and each functions to rotate the connected drum 2A or 2B. As such, rotation of the shaft (not indicated) of each motor 9 provides an indication of the rotational speed of the connected drum 2A or 2B, and thus the speed of the vehicle 1, as discussed in further detail below. Further, the vehicle 1 also includes an operator station 11 disposed on the frame 5 and containing various operator control devices, including the selector device 27, as discussed above and in further detail below.

Alternatively, the control system 10 may be used with the wetting system 12 of another type of compacting vehicle 1, such as for example a single drum compacting vehicle 1 having a pair of wheels (not shown) rotatably mounted to the frame 5 in place of one of the drums 2A or 2B. Further, it is within the scope of the present invention to use the control system 10 with any other type of vehicle 1 that incorporates a fluid applying or wetting system, such as for example a street cleaning vehicle, particularly one in which a flow of fluid proportional to vehicle speed is beneficial to vehicle operation.

Preferably, the fluid used in the wetting system 12 is either water or a mixture of water and another type of fluid, such as an appropriate wetting or releasing agent. More specifically, such appropriate other fluids include silicon-based emulsifiers or extenders, citrus-based solvents or detergent based products. Although the above fluids are preferred for the use in the wetting system 12, any other appropriate fluid may alternatively be used and the control system 10 of the present invention is in no manner limited by the type of wetting fluid.

Figure 4:
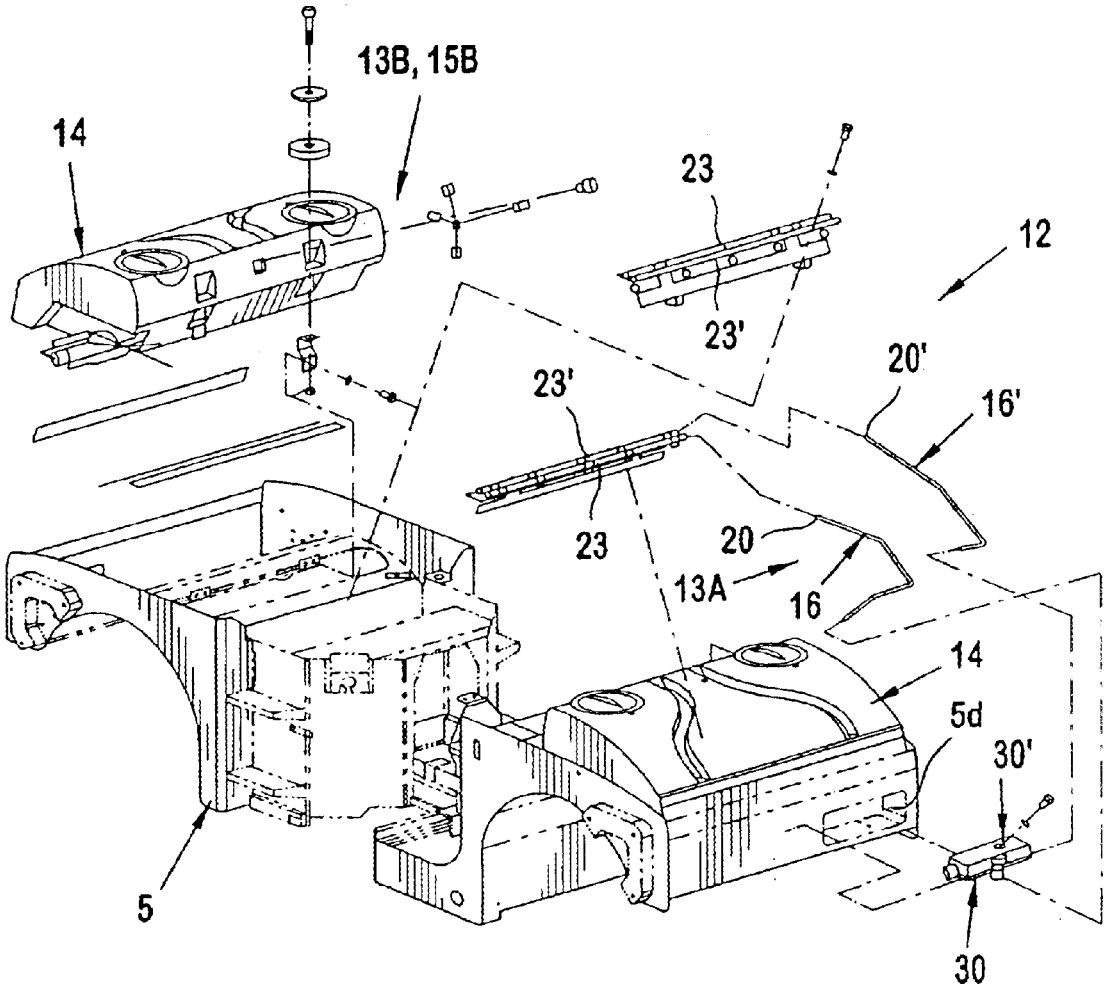
FIG. 4 is a partially exploded view of a compacting vehicle frame and various components of the wetting system.

Referring to FIGS. 1 and 4, the wetting system 12 preferably includes two separate, primary fluid circuits 13A, 13B connected with the vehicle frame 5 and each located generally proximal to a separate one of the drums 2A, 2B. As such, each fluid circuit 13A and 13B is arranged to deliver fluid to only the proximal drum 2A or 2B, respectively. However, the control system 10 preferably includes only a single logic circuit 26 configured to control both fluid circuits 13A, 13B, as discussed in further detail below. Preferably, the two hydraulic circuits 13A, 13B are substantially identically constructed and operate in a substantially identical manner, such that a detailed description and depiction one fluid circuit, specifically fluid circuit 13A, is sufficient to clearly disclose the control system 10 of the present invention. Further, the wetting system 12 preferably includes two auxiliary hydraulic circuits 15A, 15B each connected with the vehicle frame 5 and disposed generally proximal to a separate one of the primary circuits 13A, 13B, respectively, and thus also proximal to one of the drums 2A or 2B, respectively, as discussed in further detail below.

Referring to FIGS. 2–5, preferably, each primary fluid circuit 13A, 13B includes a fluid supply 14, a fluid delivery line 16 (i.e., with an inlet 18 and an outlet 20) and a regulator 22. The fluid circuits 13A, 13B each further include a separate primary pump 30 fluidly connected with the associated delivery line 16 at an "operational" position (i.e., as opposed to a physical location) between the fluid supply 14 and the delivery line outlet 20. Each pump 30 is configured to effect transfer of fluid from the supply 14 and to (and through) the delivery line outlet 20. Further, the connection of each pump 30 into the associated fluid circuit 13A or 13B divides the connected fluid delivery line 16 into two delivery line portions 17 and 19. More specifically, a first line portion 17 extends between the fluid supply 14 and a pump inlet 34 and includes the delivery line inlet 18 and a second line portion 19 is attached to a pump outlet 36 and includes the delivery line outlet 20, as discussed in further detail below.

Further, each hydraulic circuit 13A, 13B preferably includes a fluid distributor 21 fluidly connected with the associated line outlet 20 and configured to spread or diffuse the fluid generally evenly across the associated drum 2A or 2B. The distributor 21 is preferably attached to the second line portion 19 such that fluid flow through the delivery line outlet 20 enters the distributor 21 and is apportioned across the lateral width W of the proximal drum 2A or 2B. Preferably, the distributors 21 are each constructed similar to a "spray bar" 23 as known in the compacting vehicle art. More specifically, each spray bar 23 includes an elongated tubular body 29 having an inlet 31 fluidly connected with the fluid line outlet 20 and a plurality of outlet ports 33 spaced apart across the body 29. Further, the spray bars 23 are each connected to the vehicle frame 5 such that the tubular body 29 extends generally parallel with the axis 3 of the proximal drum 2A or 2B. As such, flow from the delivery line outlet 20 is generally evenly apportioned across the lateral width W of the drum 2A, 2B so as to coat substantially the entire drum outer surface 4.

Although the described spray bar 23 structure is preferred, the distributor 21 may be constructed in any other appropriate manner that effectively apportions fluid across the drum outer surface 3, such as for example, a sprayer head with multiple ports angled outwardly from a common center (not shown). Alternatively, although not preferred, the wetting system 12 may be constructed without the distributors 21, such that fluid flows from each delivery line outlet 20 and directly onto the outer surface 4 of the proximal drum 2A or 2B.

Figure 5:
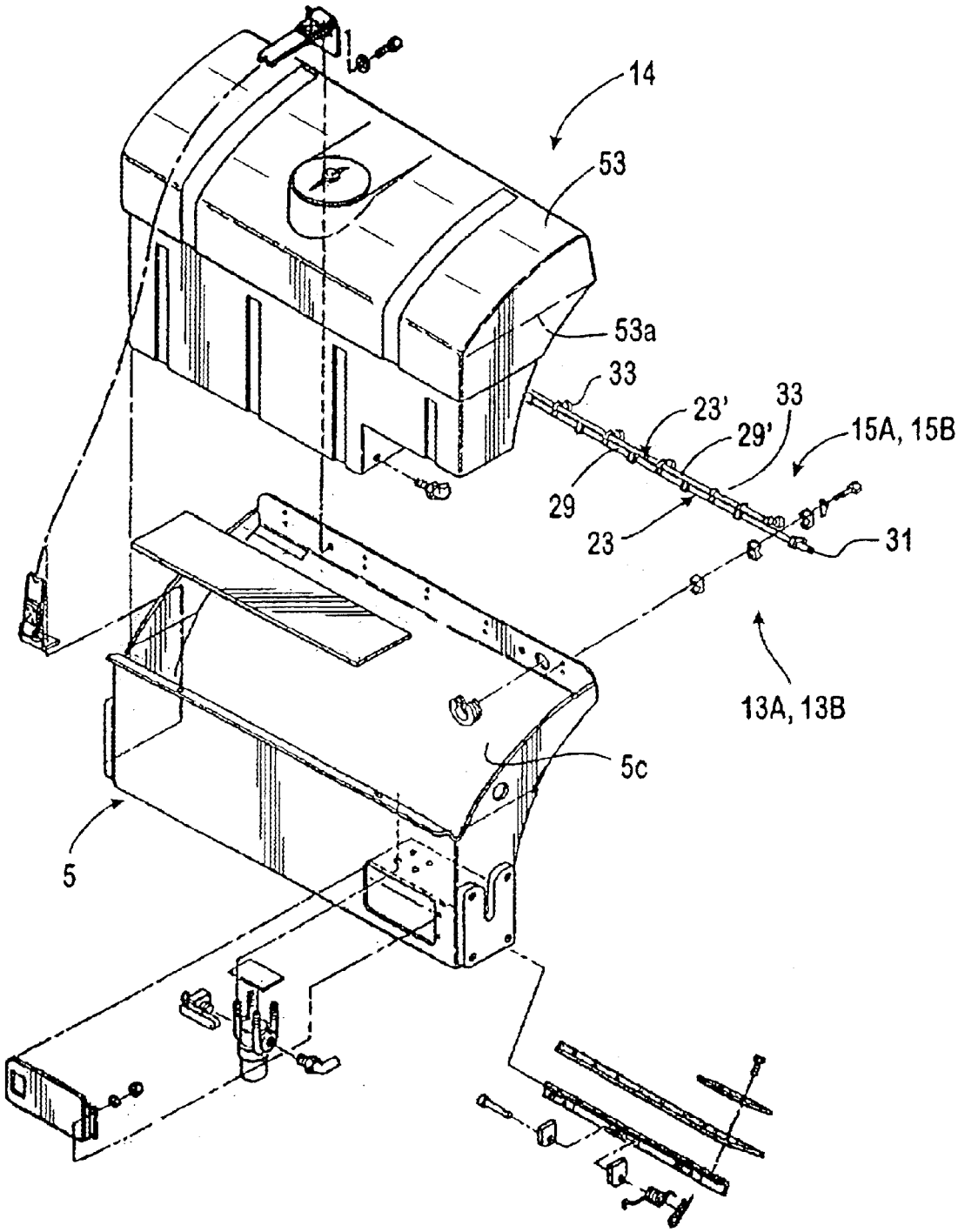
FIG. 5 is a enlarged, exploded view of a portion of the vehicle frame and certain components of the wetting system.

Still referring to FIGS. 2 and 5, each fluid supply 14 is preferably disposed on the frame 5 at a separate one of the frame ends 5*a*, 5*b* so as to be located proximal to one of the drums 2A or 2B. Most preferably, each fluid supply 14 is constructed as a generally rectangular tank 53 having a curved, concave undersurface 53*a* that "matches " with a convex outer surface of a wheel-well portion 5*c* of the frame 5 and is generally flush with the surrounding frame walls. However, each fluid supply 14 may be constructed in any other appropriate manner (e.g., as a cylindrical drum) and/or located at any other appropriate location, such as a single fluid supply (not shown) located beneath the operator station 11 and providing fluid to both circuits 13A and 13B.

Figure 6:
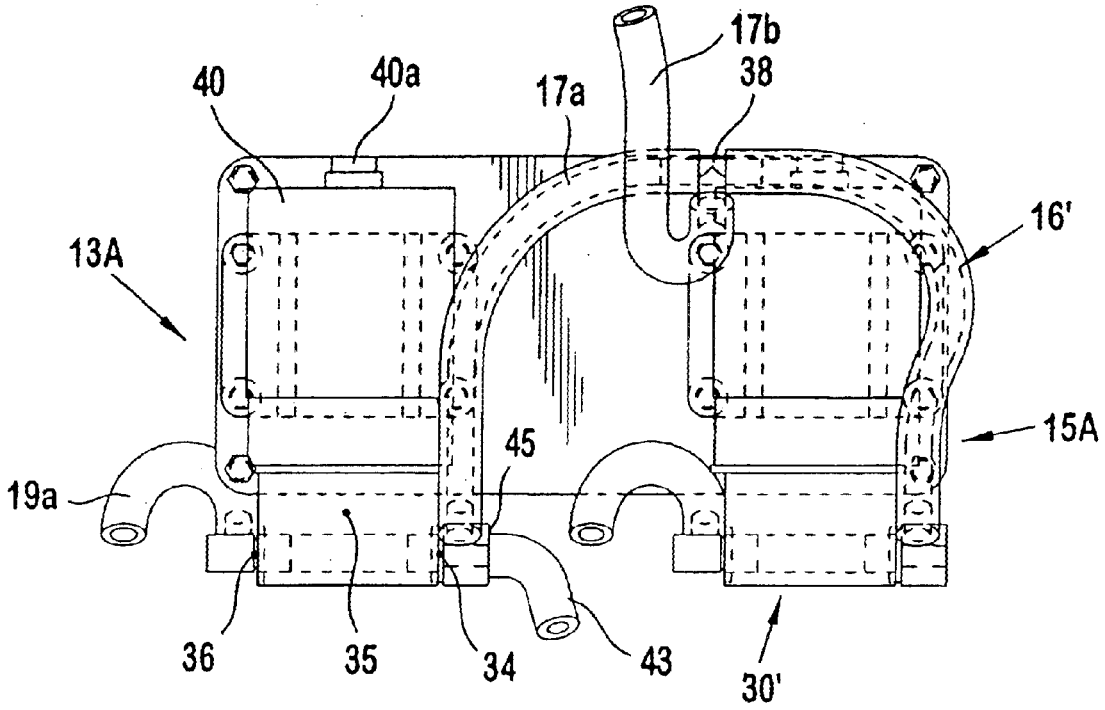
FIG. 6 is a partially broken-away, top plan view of a primary pump and an auxiliary pump used in the wetting system.

Referring to FIGS. 4–6, the wetting system 12 preferably includes two auxiliary hydraulic circuits 15A, 15B to provide a "back up" in an event of a failure in the primary fluid circuits 13A and 13B. Additionally, the auxiliary circuits 15A, 15B may be operated simultaneously with the primary circuits 13A, 13B to apply a greater total quantity or volume of fluid onto the outer surfaces 4 of the drums 2A and 2B. Although the auxiliary circuits 15A, 15B are generally similar to the primary hydraulic circuits 13A, 13B, the auxiliary circuits 15A, 15B do not include regulators 22 and are not configured to function in the manner of the primary circuits 13A, 13B as described herein. Each auxiliary circuit 15A, 15B includes a delivery line 16' having an outlet 20' disposed proximal to one of the drums 2A or 2B and being fluidly connected with the delivery line 16 of the proximal primary circuit 13A, 13B, respectively. More specifically, a flow divider valve 38 connects each proximal pair of lines 16 and 16' such that the two lines 16, 16' share an outer first line subportion 17*b* (as discussed below), an inlet 18 and a fluid supply 14. Further, each auxiliary circuit 15A, 15B includes a pump 30' disposed proximal to the pump 30 of the associated primary fluid circuit 13A or 13B and a spray bar 23' fluidly connected with the outlet 20' and extending across the width of the associated drum 2A or 2B. Although the auxiliary circuits 15A, 15B are preferred, the wetting system 12 may be provided without any auxiliary fluid circuits or the circuits 15A, 15B may be constructed in any other appropriate manner.

Referring now to FIGS. 2–7, each pump 30 is disposed at an appropriate location on the vehicle frame 5 proximal to the associated drum 2A or 2B, and most preferably, each is mounted within a separate frame compartment 5*d* located adjacent to each one of the drums 2A and 2B. Preferably each pump 30 is generally constructed as a known, conventional pump, most preferably as a positive displacement diaphragm pump. More specifically, each pump 30 is preferably a Model No. 8006-142-820 manufactured by and commercially available from SHURFlo Pump Manufacturing Company of Santa Anna, Calif. As positive displacement pumps are generally known, a detailed description of the pumps 30 is unnecessary and beyond the scope of the present disclosure; however, the following brief discussion is provided to add further clarity to certain aspects of the present invention as described further below.

Figure 7:
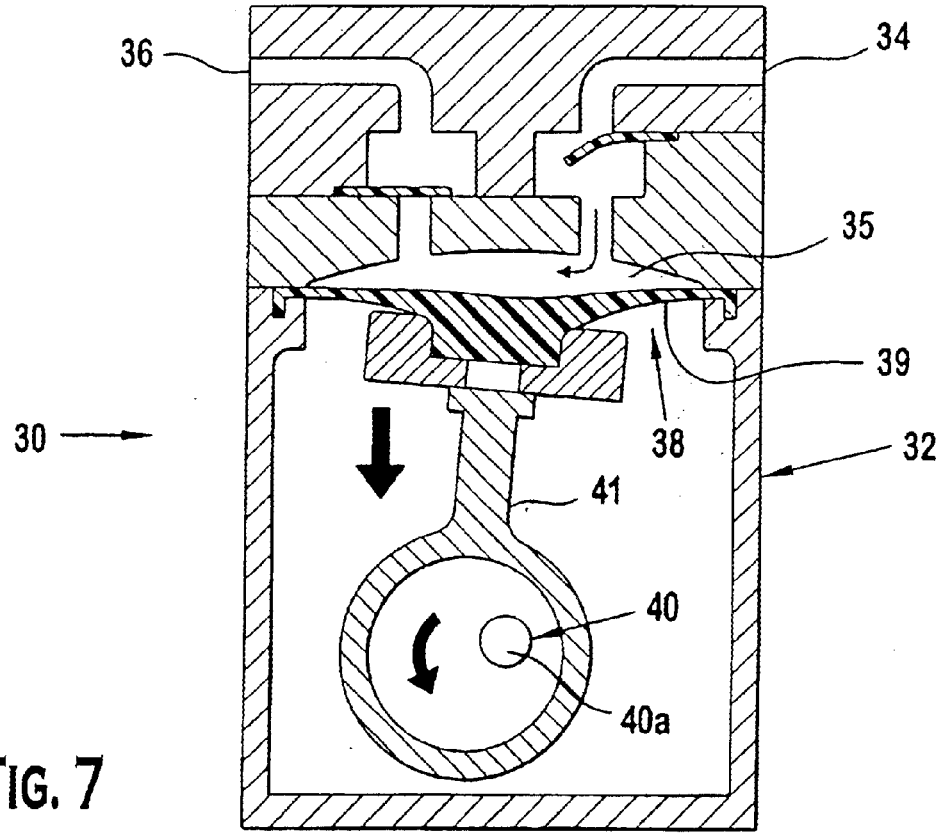
FIG. 7 is an enlarged cross-sectional view of the primary pump.

Referring particularly to FIG. 7, each pump 30 preferably includes a body 32 enclosing an interior chamber 35 and having an inlet 34 and an outlet 36, the inlet 34 and the outlet 36 each being fluidly connected with the chamber 35. The pumps 30 each have a moveable member, most preferably a diaphragm 39, configured to reciprocate so as to periodically vary the volume of the chamber 33. Further, a motor 40 has a shaft 40*a* operatively connected with the diaphragm 39 by means of a connector rod 41. In operation, the motor 40 actuates the connector rod 41 such that the rod 41 alternately deflects the diaphragm 39 in first and second opposing directions. In a first direction, the deflection of the diaphragm 39 increases chamber volume so as to "pull" fluid to flow into the chamber 33 through the pump inlet 34. In the second direction, the deflection of the diaphragm 39 decreases chamber volume so as to thereby "push" the fluid to flow out of the chamber 33 through the pump outlet 36. As such, fluid flows out of the pump outlet 36 and into the delivery line second portion 19 as discrete "pulses" of a particular quantity of the fluid, the frequency of the pulses determining the flow rate into the second line portion 19.

Further, each pump 30 is preferably configured to operate at a constant "speed"; in other words, the motor shaft 40*a* rotates at a generally constant speed such that the frequency of the deflection of the pump diaphragm 39, and thus also the frequency of the pulses of water flowing out of the pump outlet 36, is generally constant. Alternatively, the pump 30 may be configured to be operated at various rates or speeds, by either varying the speed of the shaft 40*a* or by varying the stroke of the connector rod 41 to adjust the fluid volume of each of the fluid pulses, as discussed in further detail below.

Referring to FIGS. 3, 6 and 7, the motor 40 is preferably an electric motor electrically connected with the control system 10 through an electric circuit 55. Most preferably, the motor 40 is an integral component of the preferred Model #8006-142-820 pump. With an electric motor 40, the wetting system 12 further includes an electric power source 57 disposed at an appropriate location within the vehicle frame 5, as depicted in FIG. 3. Preferably, the power source 57 is a main generator (not shown) operated by the primary engine 7 of the compacting vehicle 1 and used to provide electric power to various systems of the vehicle 1, but may alternatively be provided by a separate generator or by a battery. As a further alternative, the motor 40 may be a hydraulic or pneumatic motor, or each pump 30 may be operated another type of hydraulic, electric or pneumatic rotary or linear actuator appropriate for the particular type of pump 30, with the power source 57 being an appropriate type for the particular type of pump and/or motor (e.g., a separate hydraulic pump or a compressor).

Referring particularly to FIG. 2, in a first preferred construction, each regulator 22 is a fluid shunting device 42 including a fluid shunt line 43 fluidly connected with the associated delivery line 16 and a valve 44 controlling flow through the shunt line 43, and thereby through the delivery line outlet 20. The fluid shunt line 43 has an inlet 43*a* fluidly connected with the fluid delivery line 16 and an outlet 43*b* fluidly connected with either the fluid supply 14 (dashed lines in FIG. 2) or preferably with the pump inlet 34 (solid lines in FIG. 2) by a flow divider valve 45. The valve 44 is operably connected with the logic circuit 26 and is fluidly connected with the shunt line 43. Further, the valve 44 is configured to adjust a flow rate through the shunt line 43 so as to inversely adjust the flow rate $R_A$ through the delivery line outlet 20. More specifically, the shunt fluid line 43 redirects or diverts at least a portion of the fluid flow $F_P$ exiting the associated pump 30 (i.e., from pump outlet 36) away from the delivery line outlet 20 and back to either the fluid supply 14 or, most preferably, directly back into the pump inlet 34. The remaining portion of the fluid flow $F_A$ passes through the delivery line outlet 20, the valve 44 being positioned (i.e., under control of the logic circuit 26) such that this remaining flow portion $F_A$ passing through the outlet 20 is generally proportional to the sensed vehicle speed S.

Thus, the fluid shunt type regulator 42 functions to basically divide or split the fluid flow $F_P$ from the pump outlet 36 into two separate flow portions: a first or shunt flow portion $F_S$ through the shunt line 43 and a second or delivery flow portion providing the applied flow $F_A$ through the delivery line outlet 20. Further, the valve 44 is positionable or configurable such that the two flow portions $F_S$ and $F_A$ are each preferably variable between substantially the entire quantity or volume of fluid flowing from the pump outlet 36 and substantially zero quantity/volume of the pump outlet flow $F_P$, the two flow portions $F_S$, $F_A$ being inversely proportional to each other.

Preferably, the valve 44 is directly connected with or disposed in the second delivery line portion 19 such that valve 44 divides the second line portion 19 into two subportions: an inner subportion 19*a* extending between the pump outlet 36 and the valve 44 and an outer subportion 19*b* extending between the valve 44 and the delivery line outlet 20. Further, the inlet end 43*a* of the shunt line 43 is preferably directly connected with the valve 44, to thereby connect the shunt line 43 with the delivery line 16, and the shunt outlet end 43*b* is preferably connected with the first delivery line portion 17*a* by the divider valve 45, as discussed above. As such, the shunt line 43 essentially re-circulates fluid from the pump outlet 36 back to the pump inlet 34.

Still referring to FIG. 2, the valve 44 is preferably a three-port valve including an inlet port 46 connected with the line inner subportion 19*a* and two outlet ports 47 and 48. A first outlet port 47 is connected with the line outer subportion 19*b* and a second outlet port 48 is connected with the shunt line 43 (i.e., with the end 43*a*). Further, the valve 44 is adjustable between first and second "limit" positions, and all positions therebetween (as discussed below), to variably apportion fluid flow between the fluid line outer subportion 19*b* (and thus the delivery line outlet 20) and the shunt line 43. In the first limit position (not indicated), the valve 44 is positioned/configured to direct substantially all fluid flow entering the inlet port 46 to the outlet port 47 connected with fluid delivery line 16. In other words, when so arranged, the valve 44 essentially directs substantially all flow $F_P$ from the pump 30, originating from the fluid supply 14, through the delivery line outlet 20 and into the spray bar 23 (i.e., $F_A=F_P$, $F_S=0$). Thus, in the first limit position, the valve 44 provides a maximum rate of fluid flow $R_A$ to the associated drum 2A or 2B.

In the second limit position (not indicated), the valve 44 is positioned/configured to direct substantially all the fluid flow $F_P$ entering the valve 44, i.e., originating from the fluid supply 14 as induced by the pump 30, to the outlet port 48 connected with the shunt fluid line 43. As such, the fluid flow $F_P$ is essentially re-circulated from the pump outlet 36 back to the pump inlet 34 (i.e., $F_A=0$, $F_S=F_P$). Thus, in the second limit position, the flow rate $R_A$ through the delivery line outlet 20 is substantially zero (i.e., substantially no flow), such that no amount of fluid is directed onto the associated drum 2A or 2B. Furthermore, each valve 44 is adjustable to any position or configuration between the first and second limit positions, to thereby enable the flow rate $R_A$ out of the delivery line outlet 20 to be varied or adjusted to virtually any rate between the maximum flow rate and the minimum or "zero" flow rate. More specifically, the valve 44 is adjustable to a plurality of intermediate positions or configurations (none shown) between the first and second limit positions. Each intermediate valve position causes the flow rate $R_A$ through the outlet 20 to have a separate value that is different than the values of the flow rate $R_A$ caused by all the other intermediate valve positions. Further, the adjustment of the valve 44 to any of the valve positions is controlled by the logic circuit 26, as discussed above and in further detail below.

Preferably, the valves 44 are each electrically-actuated and electrically connected with the logic circuit 26, such that each valve 44 is operated by control signals received from the logic circuit 26, as described in further detail below. With the preferred valve structure, each valve 44 further includes an electric actuator 49, preferably a linear actuator and most preferably a solenoid 51. Further, the valves 44 are each preferably configured as a spool-valve having a sliding spool 53 operated by the solenoid 51 so as to adjust the fluid flow into the inlet port 46 between the two valve outlet ports 47 and 48.

Although the above-described configuration and arrangement of the valve 44 of the fluid shunting device 42 is presently preferred, the valve 44 may be constructed or arranged in any other appropriate manner. For example, the valve 44 may be a two-way valve (not shown) configured to directly control flow only through the shunt line 43. More specifically, the valve 44 may have an inlet port connected with either the outer fluid line subportion 19*b* or with the shunt line 43 and a single outlet port connected with the shunt line 43 (structure not shown). Such an alternative structure of the valve 44 is capable of merely adjusting the rate of flow between the valve inlet and the outlet, and thereby the amount of fluid shunted-away or redirected from the delivery line 16. In other words, when the valve 44 is in a first or fully-open position, a maximum flow portion is diverted from the delivery line 16, therefore reducing the volume of the fluid portion flowing through the outlet 20 and to the drum 2A or 2B. In a second, fully-closed position, no flow is shunted away from the delivery line 16, such that the entire flow $F_P$ from the associated pump 30 is directed onto the drum 2A or 2B. However, such a valve arrangement is not presently preferred as it does not enable the flow to the drums 2A, 2B to be substantially interrupted or stopped, but may be desirable if a continuous, but variable, fluid flow to the drums 2A, 2B is preferred at all times.

Further for example, the valve 44 of each of the shunting devices 42 may have any appropriate type of moveable "working" element, such as a ball, poppet or sliding plate, and/or may be actuated by another type of electric actuator, such as an electric motor. As yet other examples, the valves 44 may each alternatively include a hydraulic or pneumatic actuator, such as for example, a hydraulic piston or a pilot valve operated by a hydraulic control signal, or may be provided by any other type of automatically-controllable valve. The scope of the present invention includes the alternatives described above and all other appropriate configurations of the fluid shunting device 42 that enable the control system 10 of the present invention to function generally as described herein.

Referring now specifically to FIG. 3, in a second preferred construction, each regulator 22 is a pump regulator 50 configured to adjust operation of a separate one of the pumps 30 so as to adjust the flow rate through the associated delivery line outlet 20. More specifically, the pump regulator 50 adjusts the pump 30 to vary the pump output flow $F_P$ so as to thereby adjust the flow rate through the connected second line portion 19 and out of the delivery line outlet 20 (i.e., flow rate $R_A$) . Preferably, the pump regulators 50 are each further configured to start operation of the associated pump 30 and to alternately stop operation of the associated pump 30. In other words, each regulator 50 is configured to start or "turn-on" the associated pump 30 when the pump 30 is in a non-operational state (i.e., turned-off), such that the flow rate $R_A$ through the delivery line outlet 20 increases from about a zero flow rate to a desired flow rate. Further, the pump regulators 50 are configured to stop operation of or "turn off" the pumps 30 during pump operation, such that the fluid flow $F_A$ through the delivery line outlet 20 decreases from a flow rate $R_A$ of some magnitude to about a zero flow rate.

Preferably, the pump regulators 50 are each a motor actuator 52 operatively connected with the associated pump motor 40 and configured to adjust the rotational speed of the motor shaft 40*a* so as to proportionally adjust the rate of flow $R_A$ through the delivery line outlet 20. In other words, the motor actuators 52 each cause the associated motor shaft 40*a* to rotate faster to increase the flow rate from the pump outlets 36 and alternately decrease the rotational speed of the associated motor shaft 40*a* so as to decrease the flow rate from the pump outlet 36. Preferably, each motor actuator 52 is an electrical voltage regulator, and most preferably a pulse width modulator ("PWM"). Being a PWM device, the motor actuator 52 is configured to vary the current applied to the associated pump motor 40 by an electric power supply 57, to thereby vary the rotational speed of the motor shaft 40*a*. As PWM devices are well known to those skilled in the electrical and control system arts, a detailed description of such a device is unnecessary and beyond the scope of the present disclosure.

However, the motor actuators 52 may alternatively be any other type of actuator configured to vary motor speed, such as a variable resistor that varies current through the motor 40, a transmission device connected with the motor shaft 40*a* and the connector link 41 configured to vary the speed ratio between the motor shaft 40*a* and the pump 30, or any other appropriate device to vary the speed of rotation of the motor 40 and/or to vary the rotational speed transferred to the pump 30 by the motor shaft 40*a* (none shown). Further, the pump regulators 50 may alternatively be provided by any other appropriate device (i.e., other than a motor actuator) for adjusting pump operation. For example, the pump regulators 50 may each be a device (not shown) configured to adjust the volume of fluid flowing into and out of the pump 30 while the speed of the motor 40 remains generally constant. Such a device may be configured to adjust the stroke length of the connector rod 41 attached to the diaphragm 39 in the preferred diaphragm pump 30, to thereby increase or decrease the amount of deflection of the diaphragm 39. The scope of the present invention encompasses these and all other appropriate devices for the pump regulators 50 that are capable of varying pump operation and which enable the control system 10 to function generally as described the present disclosure.

Referring to FIGS. 2 and 3, the control system 10 preferably includes two speed sensors 24 (only one depicted), each sensor 24 being configured to sense or measure the speed of rotation of a proximal one of the drums 2A or 2B. Preferably, the speed sensors 24 each sense the number of drum revolutions per a unit of time and transmits such information (e.g., as electronic signals) to the logic circuit 26. The logic circuit 26 may be configured to operate the regulators 22 by directly using "raw" speed measurements of drum revolutions per unit time or may transform the drum rotational speed to vehicle travel speed from the known dimensions of the drum, i.e., vehicle speed S=drum angular velocity×drum diameter. Clearly, the rotational speed of each drum 2A and 2B should be equal, such that a single speed sensor 24 may be used to calculate or determine vehicle speed S. However, two speed sensors 24 are preferred as the logic circuit 26 is able to compare the vehicle speed measurements from each of the two sensors 24 to detect such problems as drum slippage or malfunctioning of the sensors 24 which may affect the sensed or measured drum speed.

Preferably, each speed sensor 24 is a Hall Effect sensor 58 disposed within the motor 9 of each drum axle assembly 6 and configured to sense rotation of the shaft (not depicted) of the motor 9. The logic circuit 26 calculates vehicle speed S from the measurements of motor shaft rotation by the Hall Effect sensor 58 using known relationships between motor speed and drum rotational speed and between drum speed and vehicle speed S (as discussed above). More specifically, the Hall Effect sensors 58 sense magnetic pulses generated by rotation of sensor targets (not shown) mounted on the motor shaft (not shown), the number of pulses per shaft revolution being constant, such that the logic circuit 26 calculates vehicle speed S from the number of these pulses per a particular unit of time and from a known proportional relationship between motor rotation and drum rotation (e.g., ten motor shaft rotations per each drum shaft rotation).

Further, due to the manner in which the Hall Effect sensors 58 operate, the logic circuit 26 is able to monitor or determine the rotational displacement $d_R$ of the drums 2A, 2B merely by tracking the number of pulses. Therefore, each Hall Effect speed sensor 58 also functions as a displacement sensor, such that the control system 10 preferably does not require a separate displacement sensor. Alternatively, the control system 10 may further include one or more displacement sensors 25, indicated by dashed lines in FIGS. 2 and 3, each configured to sense rotational displacement $d_R$ of a proximal drum 2A or 2B. Separate displacement sensors 25 may be required if, for example, the speed sensors 24 were each provided by an alternative device, such as for example a GPS receiver as discussed below. The displacement sensors 25 may be provided by any appropriate device capable of measuring rotational displacement $d_R$ of the drums 2A, 2B, such as an optical encoder or interrupter arranged to sense rotational displacement $d_R$ of the motor shaft 9*a*, the drum axle assembly 6, or even the drums 2A, 2B themselves.

Preferably, the Hall Effect sensors 58 are each a commercially available sensor and most preferably a "Speed Sensor" manufactured and distributed by Poclain Hydraulics, Inc. of Yorkville, Wis. Although a Hall Effect sensor 58 is presently preferred, the speed sensors 24 may be provided by any other appropriate type of sensor capable of measuring at least the speed of the vehicle. For example, the speed sensor 24 may be provided by an optical encoder (not shown) sensing the rotation of the motor shafts 8*a*, of the stub shafts connecting the drums 2A, 2B to the vehicle frame 5, or of any other rotating part of the vehicle 1. Further for example, the speed sensor 24 may be provided by a GPS receiver (not shown) measuring gross vehicle speed or by any other sensor or device capable of providing an indication of the speed of the vehicle 1 and/or the drums 2A, 2B. The scope of the present invention encompasses these and all other appropriate devices for the speed sensors 24 and the displacement sensors 25 that enable the control system 10 to function as generally described herein.

Referring now to FIGS. 2, 3 and 8–11, the structure and functions of the logic circuit 26 are now described, and as used in connection with the circuit 26, the terms "configured" and "configuration" are intended to encompass all the various possibilities of forming or arranging any known type of logic circuit. As such, these terms include, but are not limited to, wiring or fabricating an analog electric logic circuit (hardwired or otherwise), fabricating and/or programming, installing software or otherwise instructing a digital electric logic circuit, and constructing or otherwise forming a hydraulic or pneumatic logic circuit. The specific structure of the logic circuit 26 is not as important as the actual functions performed by the circuit 26 as described in detail herein. It is well within the knowledge and ability of a person skilled in the control art to form, construct and/or program an appropriate logic circuit 26 that is capable of interacting with the sensors 24, with the regulator(s) 22 and with the other components of the present invention in the manner described in this disclosure.

As discussed above, the logic circuit 26 is preferably configured to alternatively operate the regulators 22 in at least two different modes; either the continuous-flow mode or the intermittent flow mode. In the continuous flow mode, the logic circuit 26 automatically operates the regulators 22, preferably either the valve 44 of the fluid shunt device 42 or the motor actuator 52, so as to maintain the flow rate $R_A$ through the delivery line outlet 20 to be generally proportional to the sensed vehicle speed S. More specifically, with the fluid shunt regulator device 42, the logic circuit 26 is configured to adjust the valve 44, i.e., by controlling displacement of the solenoid 51, to increase fluid flow $F_S$ through the shunt line 43 when sensed vehicle speed S decreases so as to proportionately decrease the flow rate $R_A$ through the delivery line outlet 20. The logic circuit 26 is further configured to alternately adjust the valve 44 so as to decrease fluid flow $F_S$ through the shunt line 43 when sensed vehicle speed S increases so as to proportionately increase the flow rate $R_A$ through the delivery line outlet 20.

Further, with the pump regulator device 50, the logic circuit 26 is configured to operate the pump regulator 50 such that the regulator 50 adjusts the pump 30 to increase the flow rate from the pump outlet 36 when sensed vehicle speed S increases so as to proportionately increase the flow rate $R_A$ through the delivery line outlet 20. The logic circuit 26 alternatively operates the pump regulator 50 to adjust the pump 30 so as to decrease the flow rate from the pump outlet 36 when sensed vehicle speed S decreases to proportionately decrease the flow rate $R_A$ through the delivery line outlet 20. More specifically, the logic circuit 26 is configured to operate the preferred PWM motor actuator device 52 to adjust the current applied to the motor 40 such that the speed of the motor shaft 40*a* is generally proportional to the vehicle speed S. In other words, the PWM device 52 increases applied voltage to increase motor shaft speed, and thereby output flow rate $R_A$, when the sensed vehicle speed S increases and decreases the applied voltage to decrease motor speed and the output flow rate $R_A$ when the sensed vehicle speed S decreases.

Referring to FIGS. 2, 3 and 8, the logic circuit 26 is preferably configured to adjust each regulator 22 to one of a plurality of specific "settings" (i.e., configurations, valve positions, voltage settings, etc.) so as to produce a specific flow rate $R_A$ for each one of a plurality of different sensed values of the vehicle speed S. In other words, the logic circuit 26 automatically adjusts the regulators 22 to a particular setting that has been predetermined to result in an output flow $F_A$ with a flow rate $R_A$ at a desired value that is generally proportional to the specific value of sensed speed S. As such, the logic circuit 26 operates the regulators 22 in the manner of an "open-loop" control, so that no actual measurement of the flow rate $R_A$ is required. For example, if constructed as a digital electric logic circuit, the logic circuit 26 may be programmed to adjust the valve 44 to a specific, predetermined valve setting, or cause the PWM device 52 to apply a particular, predetermined voltage to the pump 30, when the speed sensor 24 determines that the vehicle speed S is at a specific value or within a specific range of values.

However, the control system 10 of the present invention may be provided with a flow sensor 69 (FIG. 2) operably connected with the logic circuit 26 and configured to sense the rate of flow $R_A$ through the delivery line outlet 20. Referring now to FIGS. 2, 3 and 9, with a control system 10 having a flow sensor 69, the logic circuit 26 may be configured to generate or to store a plurality of different, desired values $V_D$ of the flow rate $R_A$, each desired flow rate value $V_D$ corresponding to a separate one of a plurality of sensed values or value ranges of the vehicle speed S. The logic circuit 26 may then be further configured to compare sensed values $V_S$ of the flow rate $R_A$ to the desired flow rate values $V_D$, and then to appropriately adjust the regulators 22 until the sensed flow rate value $V_S$ equals the desired flow rate value $V_D$ in the manner of a "closed-loop" controller. For example, if the logic circuit 26 is formed as a digital electric circuit, the logic circuit 26 may be programmed to compare a sensed flow rate value $V_S$ to a stored, desired flow rate value $V_D$ for a currently sensed value of the speed S, and then adjust the valves 44, or cause the PWM devices 52 to adjust the current applied to the pumps 30, as appropriate until sensed and stored values of the flow rate $R_A$ are generally equal.

Figure 11:
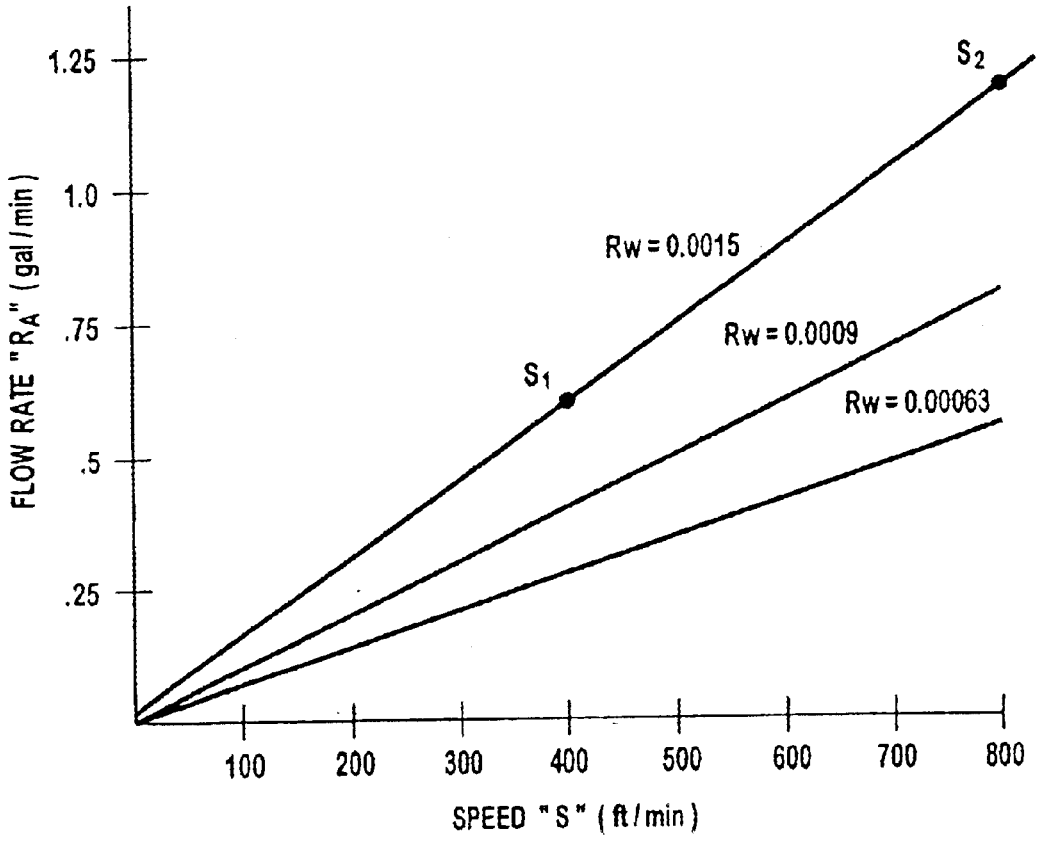
FIG. 11 is a graph depicting various alternative relations between wetting system flow and vehicle speed as established by the control system.

Referring to FIG. 11, when operating the regulators 22 in the continuous flow mode, the logic circuit 26 is preferably further configured to maintain a particular ratio between the rate of fluid flow $R_A$ through the delivery line outlet 20 and the vehicle speed S, referred to hereinafter as the "wetting rate" $R_W$, generally at a constant value. The wetting rate $R_W$, calculated as the output or applied flow rate $R_A$ divided by vehicle speed S, provides an indication as to the quantity or volume of fluid being applied by each delivery line outlet 20 onto the outer surface 3 of the associated drum 2A or 2B. The logic circuit 26 operates each regulator 22 to adjust the flow rate $R_A$ through the associated outlet 20 as required to maintain the wetting rate $R_W$ at a generally constant value.

To illustrate, assume for example that the pump 30 produces a maximum output flow of 1.2 gallons per minute ("gal/min") and the maximum vehicle speed S is 800 feet per minute ("ft/min") (about 9 mph). If the flow rate $R_A$ through the outlet 20 is measured in units of gal/min and the speed S of the vehicle 1 is measured in units of feet per minute (ft/min) (preferably sensed by measuring the number of revolutions of a drum 2A or 2B per minute ("rpm")), the logic circuit 26 may be configured to maintain the wetting rate $R_W$ at a value of $1.5\times10^{-3}$ gallons per each foot ("gal/ft") traveled by the vehicle 1. Therefore, if the vehicle speed S changes from 400 ft/min (4.5 mph) ($S_1$ in FIG. 9) to 800 ft/min ($S_2$ in FIG. 2), the logic circuit 26 operates the regulator 22 to increase the flow rate $R_A$ through the delivery line outlet 20 from about 0.6 gal/min to about 1.2 gal/min, thereby maintaining the wetting rate $R_W$ at a constant value of $1.5\times10^{-3}$ gal/ft. Although the above example assumes a specific pump flow capacity and maximum vehicle speed S, the pump flow capacity and/or and vehicle maximum potential speed may be any other appropriate value. Further, the example discusses flow rate $R_A$ and vehicle speed S in units of "gal/min" and "ft/min", respectively, the delivery flow rate $R_A$, the vehicle speed S and/or the wetting rate $R_W$ may be measured using any other appropriate units, such as speed S being measured as miles per hour ("mph") or drum rotations per minute ("rpm") or the applied flow rate $R_A$ may be measured as liters per minute ("lpm").

Further, the logic circuit 26 is also preferably configured such that the wetting rate $R_W$ is variable or adjustable to a plurality of different values, as indicated in FIG. 11. As such, the control system 10 preferably further comprises at least one adjustment device 59 operatively connected with the logic circuit 26 and configured to adjust the logic circuit 26 so as to vary the value of the wetting rate $R_W$ maintained by the circuit 26, as discussed in further detail below. For example, the adjustment device 59 may be used to adjust the logic circuit 26 such that the wetting rate $R_W$ is varied from a value of about $1.5\times10^{-3}$ gal/ft to a value of about $0.9\times10^{-3}$ gal/ft or $0.63\times10^{-3}$gal/ft, as depicted in FIG. 9. Preferably, the adjustment device 59 is a knob-operated variable resistor 61, such as a potentiometer or rheostat, located on a control console (not shown) in the operator station 11 and electrically connected with an input channel 64 of a digital electric circuit 60 (as discussed below). Alternatively, the adjustment device 59 may be any other any appropriate device capable of adjusting the logic circuit 26, such as a button inputting appropriate program commands into the digital 60, a knob adjusting gain through an amplifier in an analog electric circuit or a valve adjusting flow in a pneumatic or hydraulic logic circuit (none shown).

Referring to FIG. 10, in order to implement the second operational mode, the logic circuit 26 is further configured to automatically operate each regulator 22 such that fluid flow through the associated delivery line outlet 20 is activated and permitted for a specific period (the "wetting cycle") and the flow through the outlet 20 is alternately interrupted for a specified duration (the "interrupt cycle"). More specifically, the logic circuit 26 operates the regulators 22 to first activate or initiate the delivery line outlet flow $F_A$, by either starting pump operation or appropriately adjusting the valve 44, then permits outlet flow $F_A$ to continue for the duration of the wetting cycle, stops or interrupts the outlet flow $F_A$ for the duration of the interrupt cycle, and then again initiates delivery outlet flow $F_A$. Further, the logic circuit 26 is also preferably configured to operate the regulators 22 so that the wetting system 12 continuously operates in the wetting cycle and alternately in the interrupt cycle for as long as the compacting vehicle 1 continues moving during a compacting or "rolling" operation, as discussed in further detail below. In other words, each wetting cycle is followed by an interrupt cycle, and vice-versa, during normal compactor operation. Preferably, the logic circuit 26 includes a timer circuit or circuit portion (i.e., a clock) (not indicated) configured to provide time measurements $t_M$ to other portions of the logic circuit 26 to enable the logic circuit 26 to measure or determine the duration $T_I$ of the interrupt cycle and/or the wetting cycle time period $T_W$ (i.e., in an alternative configuration discussed below).

Preferably, to determine or measure the duration of the wetting cycle, the logic circuit 26 monitors rotational displacement $d_R$ of the drums 2A, 2B using signals received from the speed sensor 24 (or the displacement sensor 25) and then operates the regulators 22 to interrupt the output flow $F_A$ when the drums 2A, 2B have displaced by a total desired displacement "$D_D$" (e.g., one drum revolution), as indicated in FIG. 10. Alternatively, the logic circuit 26 may be configured to permit fluid flow $F_A$ through the delivery line outlet 20 for a specified period of time $T_W$, and then interrupt the fluid flow $F_A$ upon the expiration of the specified time period $T_W$ (not indicated). As depicted in FIG. 10, the outlet flow $F_A$ remains interrupted, i.e., the outlet flow rate $R_A$=0, until the logic circuit 26 determines that the specified interrupt time interval $T_I$ has elapsed, then the logic circuit 26 operates the regulators 22 such that fluid flows through the outlet 20 at the desired flow rate $R_A$. Alternatively, the logic circuit 26 may be configured to measure the duration of the interrupt cycle by monitoring the rotational displacement $d_R$ of the drums 2A, 2B and by preventing flow $F_A$ through the delivery line outlets 20 for a specified number of full or partial drum revolutions (not indicated).

Further, the logic circuit 26 is preferably also configured such that the outlet flow rate $R_A$ during the wetting cycle, the duration of the wetting cycle (in terms of either the specified rotational displacement value $D_D$ and/or the specified time period $T_I$), and/or the duration of the interrupt cycle $T_I$, are each variable or adjustable to a plurality of different values. Most preferably, the control system 10 further comprises one or more other adjustment devices 63 (two shown) operatively connected with the logic circuit 26 and configured to separately adjust the logic circuit 26 so as to separately vary the values of one or more of the applied flow rate $R_A$, of the wetting cycle rotational displacement value $D_D$, of the wetting cycle time period $T_W$, or of the interrupt time period $T_I$, to a plurality of different values. Alternatively, the adjustment device 59 may be further configured to adjust the logic circuit 26 to seperately vary one or all of the operating parameters $R_A$, $D_D$, $T_W$, and $T_I$ to a plurality of different values.

Referring particularly to FIG. 2, with the preferred regulator 22 being constructed as the fluid shunt device 42, the logic circuit 26 is configured to adjust the valve 44 to a particular configuration or position during the wetting cycle such that a desired portion, or the entire volume, of the fluid flow $F_P$ from the pump outlet 36 is directed into the first outlet port 47 and thereafter through the delivery line outlet 20. When the wetting cycle is completed, the logic circuit 26 then causes the valve 44 to move to the second limit position such that all flow $F_P$ from the pump outlet 36 flows through the second outlet port 48 and into the shunt line 43, and no flow passes through the outlet 20, so that fluid is continuously re-circulated through the pump 30 during the interrupt cycle. With the alternative pump regulator 50 shown in FIG. 3, the logic circuit 26 is configured to operate the pump regulator 50 during the wetting cycle such that the pump 30 produces fluid flow $F_P$ from the pump outlet 36, and thus through the delivery line outlet 20, at a desired flow rate $R_A$. Most preferably, the PWM device 52 applies an appropriate current to the pump motor 40 to cause the pump 30 to produce the desired flow rate $R_A$. When the wetting cycle is completed, the logic circuit 26 then causes the pump regulator 50 to halt pump operation, preferably by causing the PWM device 52 reduce to about zero the current applied to the pump motor 40, until the predetermined interrupt time period elapses.

Referring to FIGS. 8 and 9, with both operational modes, the logic circuit 26 is also preferably configured to operate the regulators 22 such that the regulators 22 substantially stop or interrupt fluid flow $F_A$ through the line outlet 20 when the sensed vehicle speed S remains at a value of about zero for at least a predetermined period of time $T_S$. In other words, when the logic circuit 26 determines that the vehicle 1 has been halted or stopped for the predetermined period of time $T_S$ (e.g., five seconds) and the wetting system 12 is operating in the continuous flow mode or the wetting cycle of the interrupt mode, the logic circuit 26 causes the regulators 22 to interrupt or stop flow $F_A$ through the outlet 20 until the vehicle 1 starts to move again. With the regulators 22 constructed as shunting devices 42, the logic circuit 26 is configured to actuate the valves 44 such that substantially all the flow from the pump outlet 36 is re-circulated to the pump inlet 34. Further, with the regulators 22 constructed as pump regulators 50, the logic circuit 26 is configured to stop operation of the pumps 30, preferably by reducing the voltage or current applied to the motor 40 to about zero volts or amperes, respectively.

In addition, the logic circuit 26 is preferably also configured to operate the regulator 22 to permit or initiate fluid to flow through the line outlet 20 when sensed vehicle speed changes from a value of about zero (e.g., 0 drum rpm or 0 mph) to a value other than zero, in other words, when the vehicle 1 begins moving from a stationary position or complete stop. Preferably, the logic circuit 26 is configured to provide a "pre-wet" operation so as to provide an initial coating of fluid to the drums 2A, 2B when the vehicle 1 is initially started or started again after a predefined period of idleness (e.g., greater than five minutes). Preferably, the logic circuit 26 operates the four pumps 30, 30' of both the primary circuits 13A, 13B and the auxiliary circuit 15A, 15B such that wetting fluid flows through the four outlet ports 20, 20' at a maximum flow rate for a predetermined period of time (e.g., five seconds). Upon completing the pre-wet operation, the logic circuit 26 either automatically operates the primary circuits 13A, 13B in either the continuous or intermittent flow modes, or allows the pumps 30 to operate in the manual mode, if so selected.

With the pump regulator 50, the logic circuit 26 always initiates fluid flow by starting operation of the pump 30. However, with the fluid-shunt device 42, the logic circuit 26 either turns on the pump 30, when the vehicle 1 and control system 10 are first started, or when the vehicle 1 is only temporarily halted during operation, the logic circuit 26 directs the valve 40 to move from the second limit position (i.e., flow entirely re-circulated through the pump 30) to another valve position. Although not preferred, the control system 10 may alternatively be configured such that the "starting" and "stopping" of the fluid flow is manually performed, i.e., as opposed to automatically by the logic circuit 26. For example, the control system 10 may be provided with one or more switches controlling regulator operation, such as a switch (not shown) controlling the electrical power supplied to the pump 30.

Still referring to FIGS. 2 and 3, the logic circuit 26 is preferably constructed or formed as an electric logic circuit 60 electrically connected with the speed sensor 24 and with the regulators 22. Most preferably, the electric logic circuit 60 is a microprocessor 62 having at least one and preferably at least three input channels 64, two of the channels 64 each being electrically connected with a separate one of the speed sensors 24 and one channel being connected with the adjustment device 61, and at least one and preferably two output channels 66 each electrically connected with a separate one of the two regulators 22. Further, the microprocessor 62 includes a programmable memory circuit (not indicated) configured to analyze input signals from the speed sensors 24 and to generate and transmit control signals to the regulators 22, as discussed below. Furthermore, the memory circuit of the microprocessor 62 is configured or programmed to selectively operate the regulators 22 in the continuous flow mode and alternatively in the intermittent flow mode, as described above.

In the continuous flow mode, the microprocessor 62 generates control signals that cause the regulators 22 to adjust the flow rate $R_A$ through the delivery line outlet 20 according to sensed vehicle speed S. More specifically, when the regulators 22 are each provided by a fluid shunt device 42, the microprocessor 62 is programmed to generate control signals that cause the solenoid 51 to actuate each valve 44 to a valve position/configuration resulting in a flow rate $R_A$ through the delivery line outlet 20 that is proportional to sensed vehicle speed S. Alternatively, when the regulators 22 are provided by PWM motor actuators 52, the microprocessor 62 is programmed to generate and transmit control signals to the PWM current regulators 52 so as to variably adjust the pump motor speed such that the resulting pump output flow $F_P$, and thus the delivery line outlet flow $F_A$, is proportional to vehicle speed S.

Further, the microprocessor 62 is preferably incorporated into a controller 70 including a housing 72 containing the microprocessor 62 and an operator interface panel 74 mounted to the housing 72. The operator interface panel 74 includes a plurality of operator input devices (e.g., push buttons or panels), including at least the selector device 27 and the adjustment device 61 and the other adjustment device(s) 63 as discussed above, and one or more display devices (e.g., indicator lights or screens)(none shown). Most preferably, the controller 70 is a LAPD MC400 version 0.2 product manufactured by Sauer Danfoss, Inc. of Minneapolis, Minn. The preferred Sauer Danfoss controller 70 is additionally configured to simultaneously control several other systems of the compactor vehicle 1, such as the vibratory mechanisms and various sensors, a description of which is beyond the scope of the present disclosure.

Although a microprocessor 62 is presently preferred, it is within the scope of the present invention to construct the logic circuit 26 in any other appropriate, desired manner. For example, the logic circuit 26 may be provided by another type of digital circuit, such as a commercially available personal computer or programmable logic control system ("PLC"), or may be provided by a "hard-wired" analog electrical circuit. Further, the logic circuit 26 may be provided by a hydraulic, pneumatic or any other type of non-electrical logic circuit (none shown) as long as the particular type of logic circuit 26 used is compatible with the particular speed sensor(s) 24 and the regulator(s) 22 used in the control system 10. The present invention encompasses these and all other alternative constructions of the logic circuit 26 that enable the control system 10 to function generally as described herein.

Having described the structure and functioning of the various system components, the manner of using the control system 10 of the present invention is readily apparent from the above description, and particularly from the description of the logic circuit 26. Basically, the control system 10 is merely activated or "turned on" by providing electric power to the preferred controller 70 or other form of the logic circuit 26, and if necessary, to various components of the wetting system 12, such as the pumps 30, the valve solenoids 51 or the PWM motor actuators 52, etc. Thereafter, depending on the operating mode selected by the vehicle operator, preferably by using an input device 76 of the controller 70, the control system 10 ensures that either a continuous, proportional flow of fluid, or an intermittent flow of fluid, is provided to the drums 2A, 2B during compactor operation. When the compacting vehicle 1 is temporarily stopped or halted, the logic circuit 26 stops fluid flow to the drums 2A, 2B and then again reestablishes such flow when the vehicle 1 resumes compacting operations.

The control system 10 of the present invention has a number of advantages over previously known control systems for construction vehicle wetting systems 12. By maintaining the fluid flow rate $R_A$ through the fluid line outlets 20 to be proportional to the vehicle speed S, the drums 2A, 2B are wetted or coated with a sufficient volume of fluid to prevent material adhesion while avoiding wetting fluid run-off. As such, the adverse effects of material adhesion and premature mat cooling, as discussed above, are substantially avoided. Further, when operating in either the continuous flow mode or the intermittent flow mode, the present control system 10 provides the benefit of delivering only the general amount of fluid necessary to keep the drums 2A, 2B appropriately wetted or coated, thereby conserving the wetting fluid contained within the onboard fluid supplies 14. As such, the control system 10 increases the productivity of the compacting vehicle 1 by reducing the frequency of operation stoppage or "down time" required to replenish the onboard fluid supplies 14.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A control system for a wetting system for applying fluid onto a drum of a compacting vehicle, the wetting system including a fluid supply and a fluid delivery line having an inlet fluidly connected with the fluid supply and an outlet located so as to direct fluid onto the drum, the control system comprising:

a regulator configured to adjust a rate of fluid flow through the outlet;

a speed sensor connected with the vehicle and configured to sense vehicle travel speed; and a logic circuit operatively connected with the speed sensor and with the regulator and configured to automatically operate the regulator when vehicle speed changes such that the regulator adjusts the flow rate through the outlet to be generally proportional to the sensed vehicle speed;

wherein the logic circuit is configured to operate the regulator such that the regulator substantially interrupts and prevents fluid flow through the outlet when the sensed vehicle speed remains at a value of about zero for at least a predetermined interval of time, and the regulator initiates fluid flow through the outlet when sensed vehicle speed changes from a value of about zero to a value other than about zero.

2. The control system as recited in claim 1 wherein the regulator is configured to increase the fluid flow rate through the outlet when the sensed vehicle speed increases and to alternatively decrease the fluid flow rate through the outlet when the sensed vehicle speed decreases.

3. The control system as recited in claim 1 wherein:

the wetting system has a plurality of the fluid lines, each fluid line having a separate outlet; and the control system includes a plurality of the regulators, each regulator being operatively connected with a separate one of the fluid lines so as to adjust the flow rate through the connected fluid line, the logic circuit being configured to operate each of the regulators separately and independently of the other regulators.

4. The control system as recited in claim 1 wherein the regulator includes a shunt fluid line fluidly connected with the fluid delivery line and a valve operably connected with the logic circuit, fluidly connected with the shunt line and configured to adjust fluid flow through the shunt line so as to adjust the flow rate through the delivery line outlet.

5. The control system as recited in claim 4 wherein the logic circuit is configured to adjust the valve to increase fluid flow through the shunt line when sensed vehicle speed decreases so as to decrease the flow rate through the delivery line outlet and to alternatively adjust the valve to decrease fluid flow through the shunt line when sensed vehicle speed increases so as to increase the flow rate through the delivery line outlet.

6. The control system as recited in claim 4 wherein the valve is a solenoid actuated control valve electrically connected with the logic circuit.

7. The control system as recited in claim 4 wherein the valve is adjustable between a first limit position at which substantially all flow from the fluid supply flows through the shunt line and a second limit position at which substantially all flow from the fluid supply flows through the delivery line outlet.

8. The control system as recited in claim 7 wherein the valve is adjustable to a plurality of intermediate positions between the first and second limit positions, each intermediate valve position causing the flow rate through the outlet to have a separate value different than the value of the flow rate caused by each other valve position.

9. The control system as recited in claim 1 wherein:

the wetting system further includes a pump connected with the fluid delivery line and configured to establish fluid flow at a variable flow rate through a portion of the fluid line extending between the pump and the outlet; and the regulator is configured to adjust the pump such that the rate of fluid flow from the pump is generally proportional to sensed vehicle speed.

10. The control system as recited in claim 9 wherein the pump includes a variable-speed electric motor and the regulator is electrically connected with the motor and is configured to adjust motor speed so as to adjust the rate of fluid flow from the pump.

11. The control system as recited in claim 9 wherein the regulator is one of a voltage regulator and a current regulator electrically connected with the logic circuit.

12. The control system as recited in claim 9 wherein the pump includes a variable-speed hydraulic motor and the regulator is a valve fluidly connected with the motor and configured to adjust motor speed so as to adjust the rate of fluid flow from the pump.

13. The control system as recited in claim 1 wherein:

the speed sensor is configured to generate electric signals corresponding to sensed vehicle speed and the regulator is configured to be responsively operable by electric control signals; and the logic circuit is a microprocessor having at least one input channel electrically connected with the speed sensor, at least one output channel electrically connected with the regulator and a programmable memory circuit configured to analyze an input signal from the speed sensor and to generate and transmit an output control signal to the regulator such that the regulator adjusts the flow rate through the outlet according to sensed vehicle speed.

14. The control system as recited in claim 13 wherein:

the fluid applying system has a plurality of the fluid lines, each fluid line having a separate outlet; and the control system includes a plurality of the regulators, each regulator being operatively connected with a separate one of the fluid lines so as to adjust the flow rate through the connected fluid line; and the microprocessor has a plurality of output channels each connected with a separate one of the regulators, the memory circuit being programmed to separately operate the regulators to separately and independently adjust flow through each of the fluid line outlets.

15. A control system for a wetting system for applying fluid onto a drum of a compacting vehicle, the wetting system including a fluid supply and a fluid delivery line having an inlet fluidly connected with the fluid supply and an outlet located so as to direct fluid onto the drum, the control system comprising:

a regulator configured to adjust fluid flow through the outlet;

a sensor configured to sense rotation of the drum; and a logic circuit operatively connected with the sensor and with the regulator and configured to operate the regulator such that fluid flow through the outlet is permitted for one of a predetermined displacement of the drum and a predetermined period of time and alternately interrupted for one of a predetermined period of time and a predetermined displacement of the drum.

16. The control system as recited in claim 15 wherein the regulator is configured to substantially prevent fluid flow through the outlet during the predetermined time period of fluid interruption.

17. The control system as recited in claim 15 wherein the regulator includes a shunt fluid line fluidly connected with the fluid delivery line and a valve configured to adjust fluid flow through the shunt line so as to inversely adjust fluid flow through the outlet.

18. The control system as recited in claim 17 wherein the valve is adjustable between a first limit position at which substantially all flow from the fluid supply flows through the shunt line and a second limit position at which substantially all flow from the fluid supply flows through the delivery line outlet.

19. The control system as recited in claim 15 wherein the logic circuit is an electrical circuit and the regulator is electrically connected with the logic circuit.

20. The control system as recited in claim 15 wherein:

the sensor is configured to send electrical position signals to the logic circuit, the position signals corresponding to a rotational position of the drum;

the logic circuit is a microprocessor configured to receive the position signals and to generate and transmit control signals to the regulator; and the regulator is an electromechanical valve configured to receive the control signals and to adjust flow through the outlet in response to the control signal.

21. A control system for a wetting system for applying fluid onto a drum of a compacting vehicle, the wetting system including a fluid supply and a fluid delivery line having an inlet fluidly connected with the fluid supply and an outlet located so as to direct fluid onto the drum, the control system comprising:

a regulator configured to adjust fluid flow through the outlet;

a sensor configured to sense rotation of the drum; and a logic circuit operatively connected with the sensor and with the regulator and configured to selectively operate the regulator in a first operational mode wherein the regulator maintains a rate of flow through the delivery line outlet to be generally proportional to vehicle speed and alternatively in a second operational mode wherein fluid flow through the outlet is permitted for a predetermined displacement of the drum and alternately interrupted for a predetermined period of time.

* * * * *